US006076433A

United States Patent [19]

Lynch

[11] Patent Number: 6,076,433

[45] Date of Patent: Jun. 20, 2000

[54] RATCHET WRENCH OPERABLE IN FORWARD, REVERSE AND NEUTRAL MODES

[76] Inventor: Joseph A. Lynch, 51 E. First Ave., Hialeah, Fla. 33010

[21] Appl. No.: 09/104,239

[22] Filed: Jun. 25, 1998

[51] Int. Cl.[7] ..... B25B 13/46

[52] U.S. Cl. ..... 81/63; 81/60; 81/63.2

[58] Field of Search ..... 81/60, 61, 62, 81/63, 63.1, 63.2

[56] References Cited

U.S. PATENT DOCUMENTS

| | | | |
|---|---|---|---|
| 685,698 | 10/1901 | Sprague | 81/63 |
| 1,425,816 | 8/1922 | Van Horn . | |
| 3,724,298 | 4/1973 | Howard | 81/63 |
| 4,111,077 | 9/1978 | Cummings et al. | 81/63 |
| 4,254,675 | 3/1981 | Marlow et al. | 81/63 |
| 4,300,413 | 11/1981 | Garofalo . | |
| 4,406,183 | 9/1983 | Wix . | |
| 4,592,255 | 6/1986 | Mayer | 81/63 |
| 4,699,028 | 10/1987 | Bosque | 81/63 |
| 4,703,676 | 11/1987 | Mayer . | |
| 4,909,106 | 3/1990 | Foreman . | |
| 4,913,009 | 4/1990 | Andersen-Vie . | |
| 5,211,087 | 5/1993 | Thomason | 81/63 |
| 5,522,288 | 6/1996 | Slusar et al. | 81/63 |
| 5,582,080 | 12/1996 | Barmore . | |

FOREIGN PATENT DOCUMENTS

| | | | |
|---|---|---|---|
| 1374052 | 11/1974 | United Kingdom | 81/63 |

*Primary Examiner*—David A. Scherbel
*Assistant Examiner*—Joni B. Danganan
*Attorney, Agent, or Firm*—Lane, Aitken & McCann, L.L.P.

[57] ABSTRACT

A ratchet wrench includes a handle, a housing attached to said handle, a ratchet gear mounted for rotation in said housing, the ratchet gear having an axis of rotation extending through the housing, and means connected to the ratchet gear for turning a threaded fastener. A pawl is mounted on the handle about a pivot axis that extends through the handle, the pawl pivoting among a first position in which the pawl permits unrestricted rotation of the ratchet gear, a second position in which the pawl engages the ratchet gear to prevent rotation of the ratchet gear in one direction, but allows rotation of the ratchet gear in the opposite direction, and a third position in which the pawl engages the ratchet gear to prevent rotation of the ratchet gear in the opposite direction, but allows rotation of the ratchet gear in the one direction. A method for turning a threaded fastener is also included.

10 Claims, 12 Drawing Sheets

RATCHET WRENCH OPERABLE IN FORWARD, REVERSE AND NEUTRAL MODES

FIELD OF THE INVENTION

The present invention relates to ratchet wrenches, and more particularly, to ratchet wrenches comprising ratchet drives operable in forward and reverse directions.

BACKGROUND OF THE INVENTION

Ratchet wrenches are known for rotating threaded fasteners, such as nuts, bolts, and screws, in one direction while the wrench handle is pivoted in a like direction. When the wrench is rotated in an opposite direction, the wrench's driving element should be disengaged, such that the fastener maintains a stationary position. In this manner, the fastener may be driven to complete insertion or removal without removing the wrench from the fastener.

Unfortunately, many conventional ratchet wrenches only partially achieve this intended operation in certain circumstances. After the wrench is pivoted in the desired direction, the ratchet drive is disengaged, but the wrench nevertheless exerts some frictional or mechanical force on the fastener, tending to rotate the fastener in an unintended reverse direction. Such force is normally resisted by the frictional engagement of the threads of the fastener with the threads of the work piece, but the fastener nevertheless turns when the threaded engagement is loose, as when the fastener is just starting to be tightened. The fastener, as a result, may oscillate back and forth with the forward and backward strokes of the wrench handle.

A conventional ratchet wrench may be manipulated to overcome an oscillating movement of a fastener when it occurs, but such manipulations are cumbersome and compromise the ability of the user to know the extent to which the fastener has been driven. Many wrenches must be removed repeatedly from the fastener, pivoted rearwardly, and then realigned with the fastener. This procedure becomes frustrating and more time consuming when realignment of the fastener and wrench is not quickly achieved.

It is accordingly an object of the present invention to provide a ratchet wrench that predictably drives a fastener when the wrench is rotated in one direction, and exerts negligible torque on the fastener when rotated in an opposite direction.

It is a further object of the present invention to provide a ratchet wrench that is operable in forward, reverse, and neutral positions without having to remove the wrench from the nut or bolt.

It is a still further object of the present invention to provide a ratchet wrench where a force that causes a pawl to achieve an engaging position is applied in the same direction as a force applied to the wrench handle to drive a fastener.

It is another object of the present invention to provide a ratchet wrench that is provided with a means for securing a pawl in at least three positions.

It is a yet another object of the present invention to provide a ratchet wrench having a pawl for changing among forward, reverse, and neutral positions that is operable entirely by one hand from the handle of the wrench, away from the area of the fastener.

Other objects of the invention will become apparent to those skilled in the art from a reading of the following detailed description.

SUMMARY OF THE INVENTION

The foregoing objectives are achieved by the present invention, which is a ratchet wrench having the ability to operate in forward, reverse, and neutral modes. The ratchet wrench has a proximal end and a distal end. The proximal end consists of a handle, and the distal end consists of a housing containing a ratchet gear which has an axis of rotation that extends through the housing. Protruding from the housing is a socket couple which receives sockets for tightening or removing fasteners. A pawl is mounted on the handle about a pivot axis that extends through the handle, and the pawl pivots among three positions. In a first or neutral position, the pawl permits unrestricted rotation of the ratchet gear. In a second position, the pawl engages the ratchet gear to prevent rotation of the ratchet gear in a first direction, but allows rotation of the ratchet gear in an opposite direction. In a third position, the pawl engages the ratchet gear to prevent rotation of the ratchet gear in the opposite direction, but allows rotation of the ratchet gear in the first direction. A means is provided for securing the pawl in each of the three positions. The pawl is operable by one hand from the handle of the wrench. The invention also includes a method for turning a fastener.

DETAILED DESCRIPTION OF THE PREFERRED EMBODIMENTS

Figure 1:
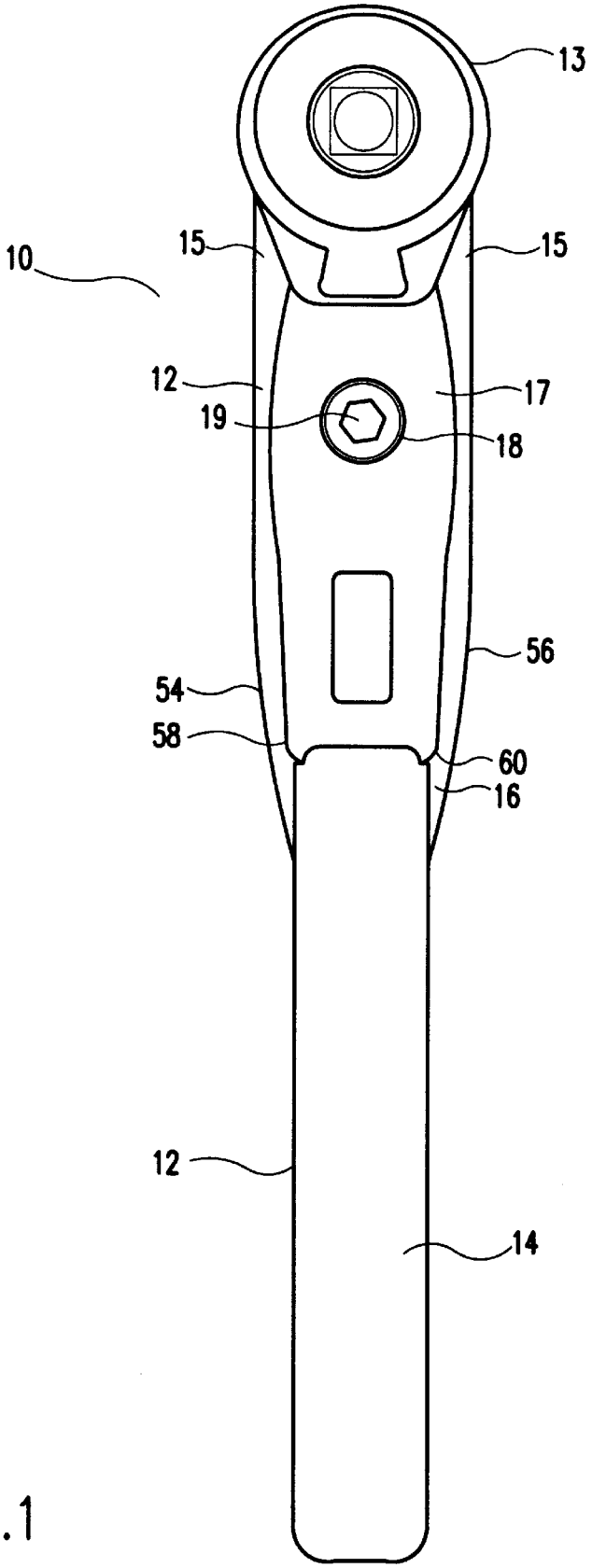
FIG. 1 is an elevation view of the ratchet wrench of the present invention.
Figure 2:
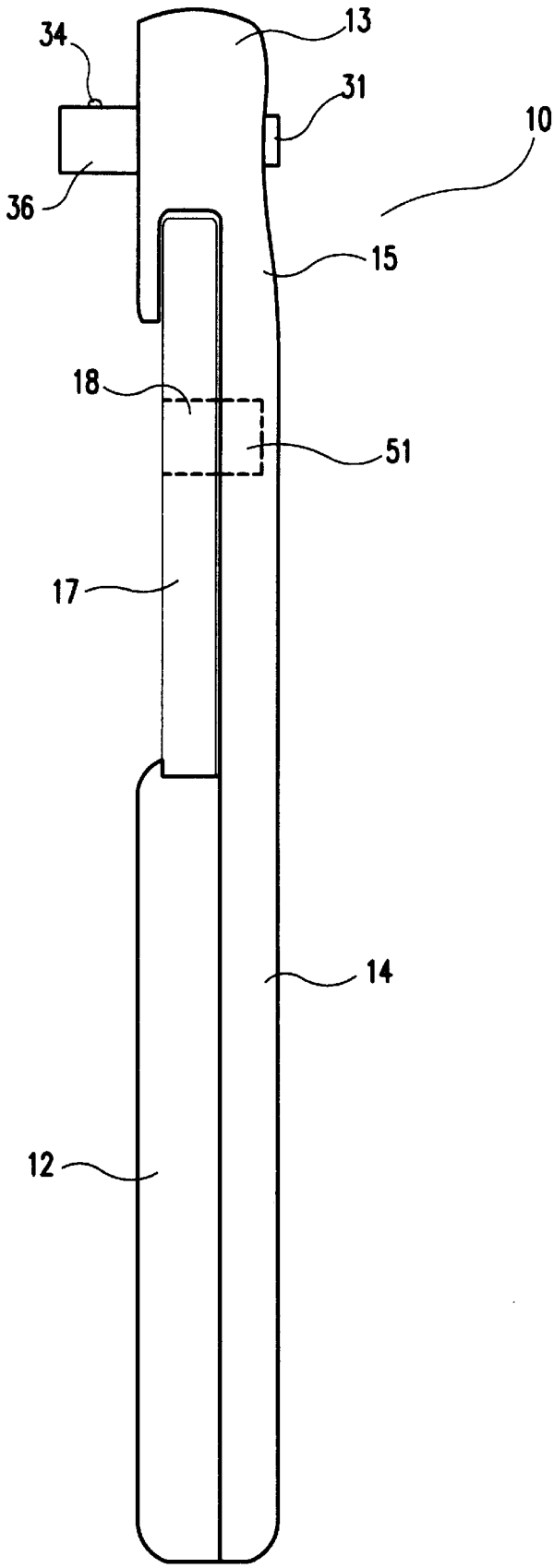
FIG. 2 is a side view of the ratchet wrench of the present invention, showing a pawl disposed in the midsection of the wrench.
Figure 3:
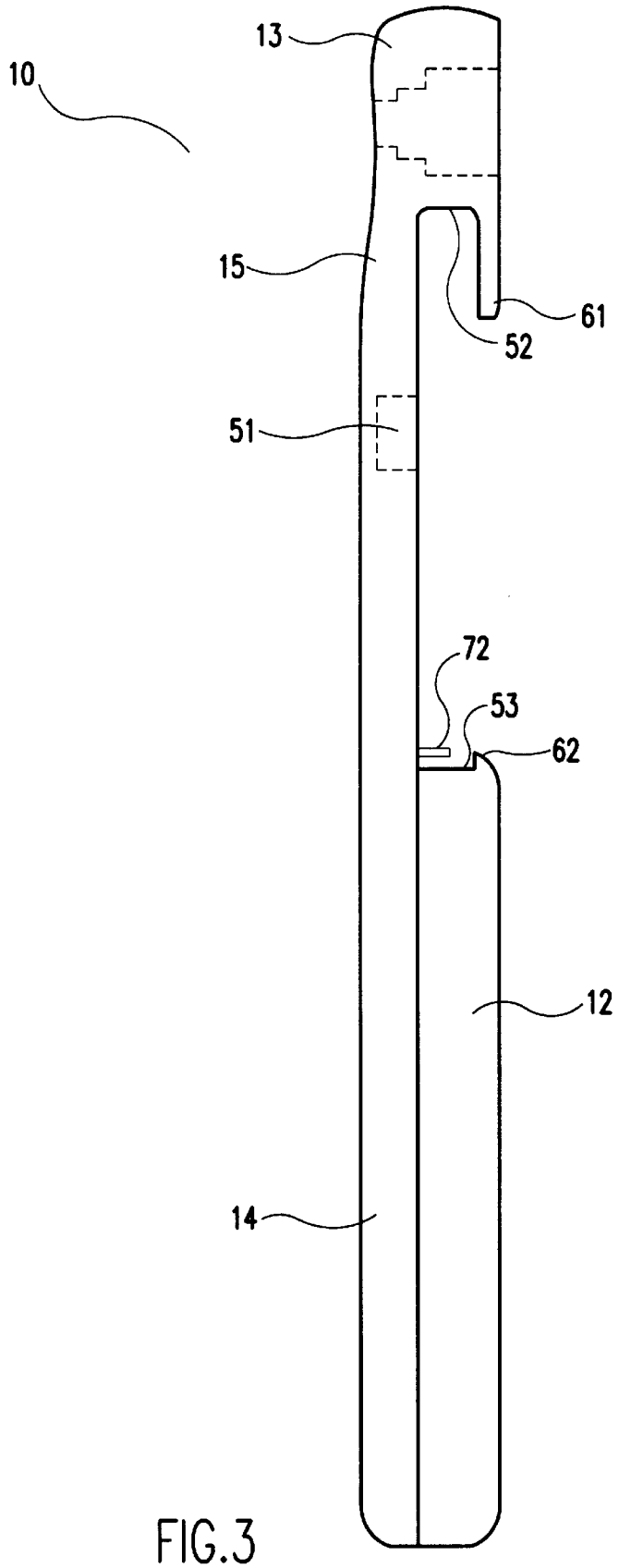
FIG. 3 is a side view of the ratchet wrench of the present invention with the pawl removed from the wrench handle and the ratchet gear and socket coupling removed from the housing.
Figure 5:
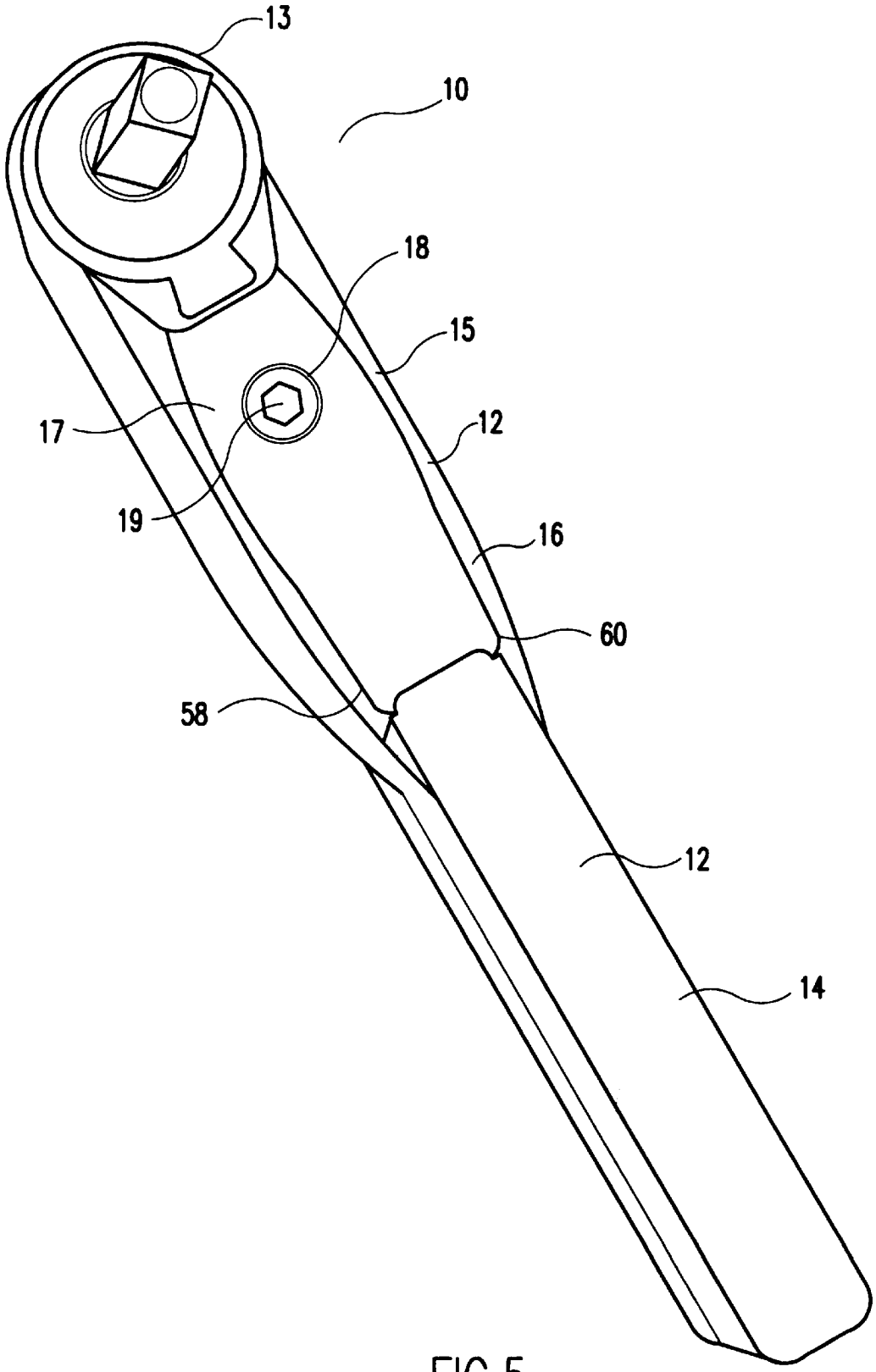
FIG. 5 is a perspective view of the ratchet wrench of the present invention.

As can be seen from FIGS. 1, 2 and 5, the ratchet wrench according to the present invention is designated generally by reference numeral 10, and comprises a proximal end with a handle 12 and a distal end with a housing 13. The handle consists of a narrow section 14 and a wider section 15, said wider section 15 being adjacent to the housing 13. Sections 14 and 15 are positioned along the same longitudinal axis and are separated by a shoulder 16. Section 14 may be constructed of one solid piece or two longitudinal pieces as shown in FIGS. 2 and 3. The handle 12 and housing 13 are preferably made of spring steel alloy, although other materials having sufficient durability and strength are suitable.

Figure 6:
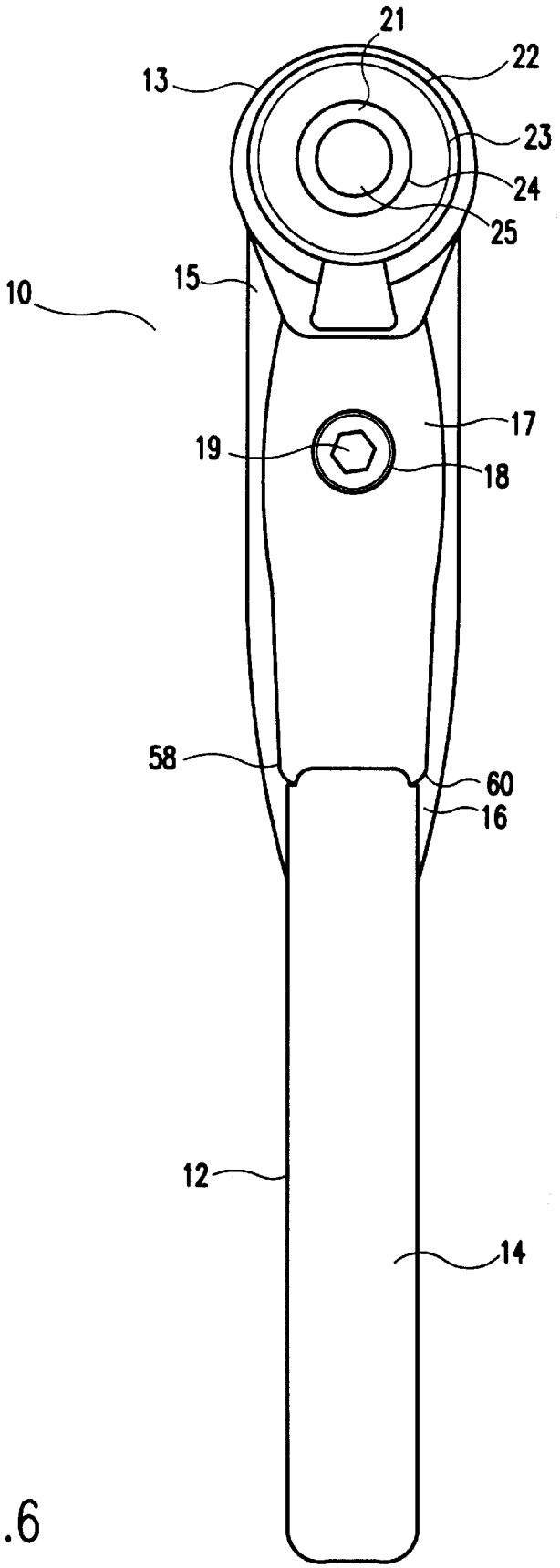
FIG. 6 is an elevation view of the ratchet wrench of the present invention with the ratchet gear removed from the housing.
Figure 7:
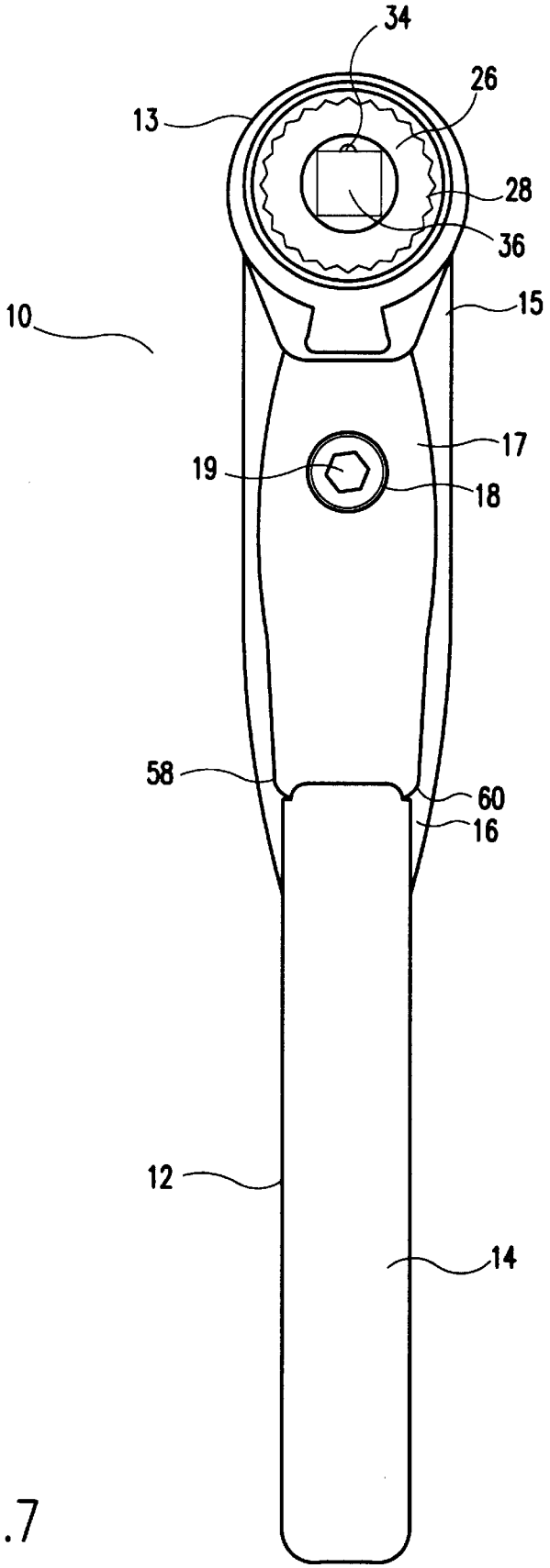
FIG. 7 is an elevation view of the ratchet wrench of the present invention with a housing cover removed thereby exposing the ratchet gear.

Concentric circular openings 22, 23, 24 and 25 are defined in housing 13. Circular opening 25 defines a longitudinal plane recessed from a longitudinal plane defined by circular opening 24, circular opening 24 defines a longitudinal plane recessed from a longitudinal plane defined by circular opening 23, and circular opening 23 defines a longitudinal plane recessed from a longitudinal plane defined by circular opening 22. A ratchet gear 26 is supported on a shelf 21 formed by the recession between openings 24 and 25 (See FIG. 6).

Figure 8:
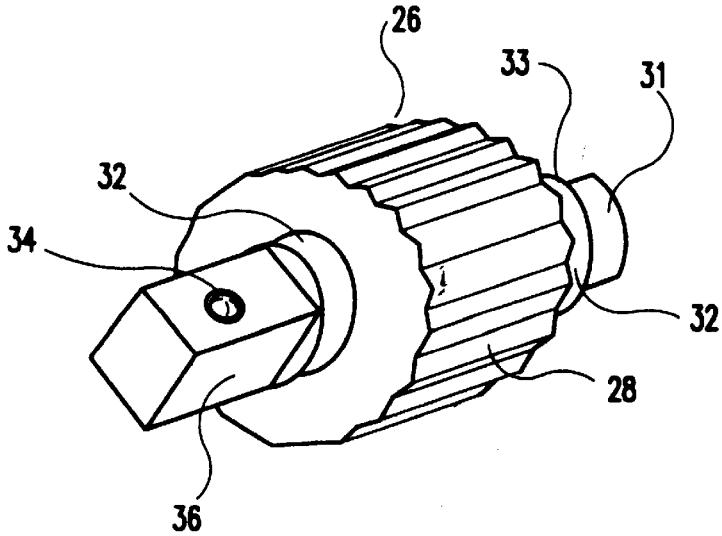
FIG. 8 is a perspective view of the ratchet gear of the present invention.

Ratchet gear 26 as illustrated in FIG. 8 includes an inner hub 31, a surrounding hub 32, a socket couple 36, and a gear concentrically surrounding outer hub 32. When placed into the housing 13, inner hub 31 protrudes through the opening 25 in back of housing 13. With its protrusion through opening 25, inner hub 31 serves as a release button for socket couple 36 which operates to retract pin 34 upon the depression of inner hub 31 as is well known in the art. The difference in radius of outer hub 32 and inner hub 31 forms a shoulder 33 which rests on shelf 21 when placed in housing 13. Inner hub 31 is of a width slightly smaller than circular opening 25 allowing it to move freely within the confines of the housing 13 about an axis of rotation that extends through the housing. Ratchet gear 26 contains 24 evenly spaced, pointed teeth 28 which project radially from the outer hub 32.

As illustrated in FIGS. 2 and 8, a four-sided socket couple 36 projects axially from outer hub 32. Socket couple 36 engages and turns a socket (not depicted) which in turn engages and turns a fastening device. It will be readily apparent that other means may project from outer hub 32 to engage threaded fasteners of different sizes and configurations.

Figure 4:
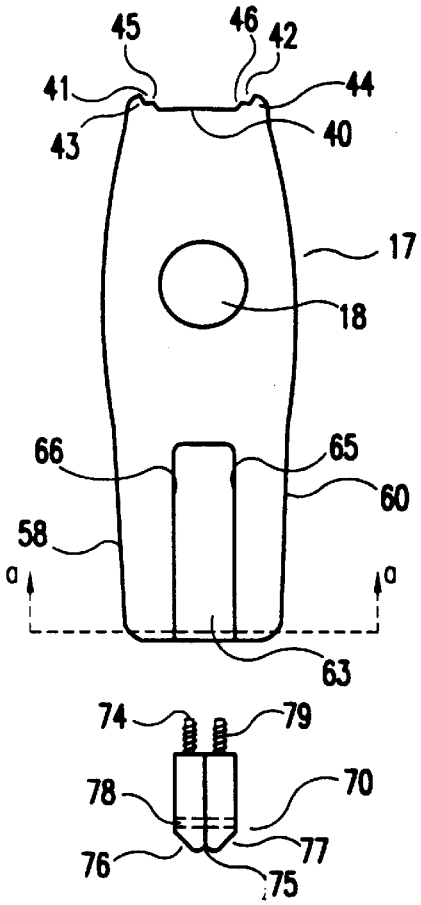
FIG. 4 is an elevation view of the pawl of the ratchet wrench of the present invention and a cam for insertion into said pawl.

Pawl 17 (see FIG. 4) is a substantially flat plate composed of tool grade steel, dimensioned to fit between shoulder 52 and lip 61 of housing 13 and shoulder 53 and lip 62 of handle 12 (See FIG. 3). FIG. 3 also illustrates positional post 72 which functions to secure pawl 17 in one of three positions. As seen in FIG. 4, pawl 17 has teeth 41, 42 which engage ratchet gear teeth 28 and prohibit rotation in one direction. Pawl 17 extends from a point adjacent to ratchet gear 26 to shoulder 16 which separates sections 14 and 15 of the handle 12. The pawl 17 includes aperture 18 which is in alignment with an aperture 51 in section 15 (See FIG. 3).

Aligned apertures 18 and 51 are defined in pawl 17 and section 15 respectively at positions spaced approximately one-third of the way from concentric circular openings 22, 23, 24, and 25. To facilitate manufacture, only aperture 51 is threaded to receive a capscrew 19. Capscrew 19 thus passes freely through aperture 18 and is retained by screwing into aperture 51. Capscrew 19 guides pawl 17 against shoulder 53, and pawl 17 is prevented from perpendicular movement by lips 61 and 62, thus securing pawl 17 in place on section 15 when capscrew 19 is secured into aperture 51. In a preferred embodiment, aperture 18 is round with a diameter just large enough to receive capscrew 19 allowing pawl 17 to pivot about the capscrew 19. In another embodiment, aperture 18 is slightly oval in shape, one end of pawl 17 is slightly convex, and shoulder 53 is slightly concave. The different shapes of these elements cause the wrench the distribute the load borne by the wrench 10 in slightly different manners as will be described in detail below.

Figure 9:
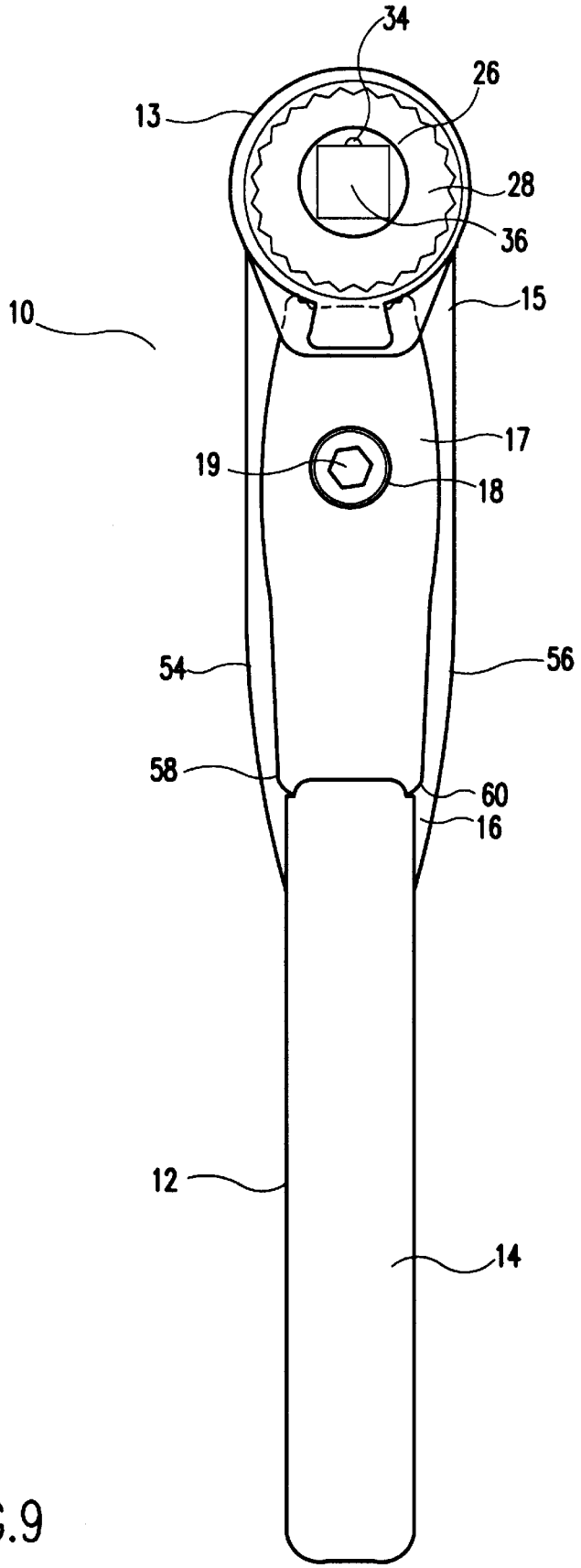
FIG. 9 is an elevation view of the ratchet wrench of the present invention with a cover of the housing removed to show the pawl in a neutral position which allows the ratchet gear to rotate freely in a clockwise or counterclockwise direction.
Figure 10:
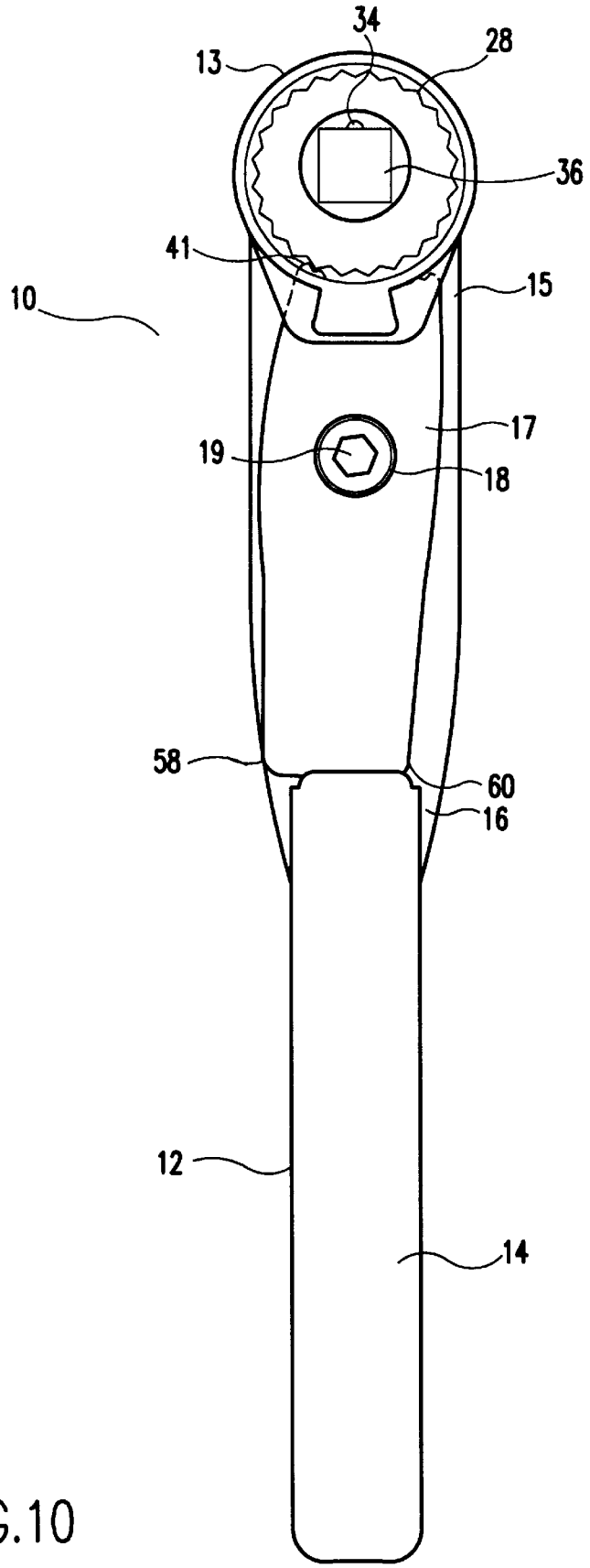
FIG. 10 is an elevation view of the ratchet wrench of the present invention with a cover of the housing removed to show the pawl in a position which allows the ratchet gear to rotate in a clockwise direction.

A stepped notch 40 is defined in an end of pawl 17 and when placed in wrench 10, notch 40 is adjacent to ratchet gear 26. When the pawl 17 is in a neutral position as illustrated in phantom in FIG. 9, ratchet gear 26 rotates freely and silently without contacting pawl 17 in the area of the stepped notch 40. However, when force is applied to pawl 17 at tabs 58, 60, pawl 17 is pivoted in one direction, and either steps 41 or 42 in notch 40 engages teeth 28 of the ratchet gear 26. Opposing tabs 58, 60 of the pawl 17 do not extend beyond the periphery of lateral edges 54, 56. This arrangement prevents unintended positional changes of pawl 17 by a user of the ratchet wrench 10. Thus, when the pawl 17 is pivoted to a position as illustrated in FIG. 10, steps 41 engage teeth 28, preventing the movement of ratchet gear 26 in a counterclockwise direction, but allowing movement of the gear in a clockwise direction. Movement is allowed in the clockwise direction because teeth 28 are able to displace steps 41 in a direction away from the longitudinal axis of wrench 10 causing pawl 17 to pivot in a counterclockwise direction about its axis formed by aperture 18. However, gear 26 is not able to rotate counterclockwise because teeth 28 cannot displace steps 41 in a direction towards the longitudinal axis of the handle 12 since further movement of pawl 17 in a clockwise direction is prevented by positional post 72. Similarly, when pawl 17 is pivoted to the position illustrated in FIG. 11, steps 42 engage the teeth 28 of the ratchet gear 26, preventing the movement of the ratchet gear 26 in a clockwise direction, but allowing movement in a counterclockwise direction.

Figure 11:
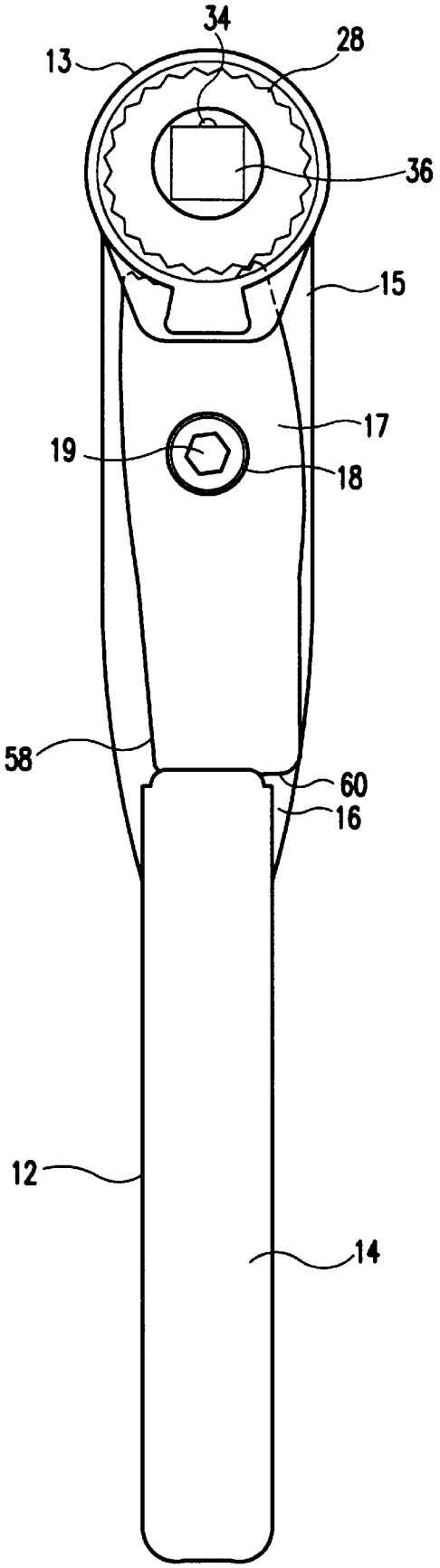
FIG. 11 is an elevation view of the ratchet wrench of the present invention with a cover of the housing removed to show the pawl in a position which allows the ratchet gear to rotate in a counterclockwise direction.

The one-way rotation of ratchet gear 26 when engaged by pawl 17, as illustrated in FIGS. 10 and 11, is accomplished by a particular sloping of steps 41, 42. The vertical surfaces 43, 44 of the steps are slanted outwardly so that the angle at which they are impinged by teeth 28 is less acute. The vertical surfaces 43, 44 thus do not arrest the movement of the ratchet gear 26. The ratchet gear 26 instead is able to outwardly displace pawl 17, urging it toward its neutral position. The horizontal surfaces 45, 46 of the steps, on the other hand, are slightly higher at their proximal edges as opposed to their distal edges. This causes teeth 28 of ratchet gear 26 to strike the horizontal surfaces 45, 46 of the steps at a more acute angle, such that the steps 41, 42 aid in arresting the movement of ratchet gear 26 in that direction. It will be readily apparent to those skilled in the art that the number of teeth on ratchet gear 26 can be varied, whereupon the dimensions and inclinations of steps 41 and 42 are adapted to make suitable engagements. Also, the number of steps 41, 42 may be suitably varied. It is important that stepped notch 40 does not contact ratchet gear 26 when the pawl 17 is in its neutral position.

Figure 12:
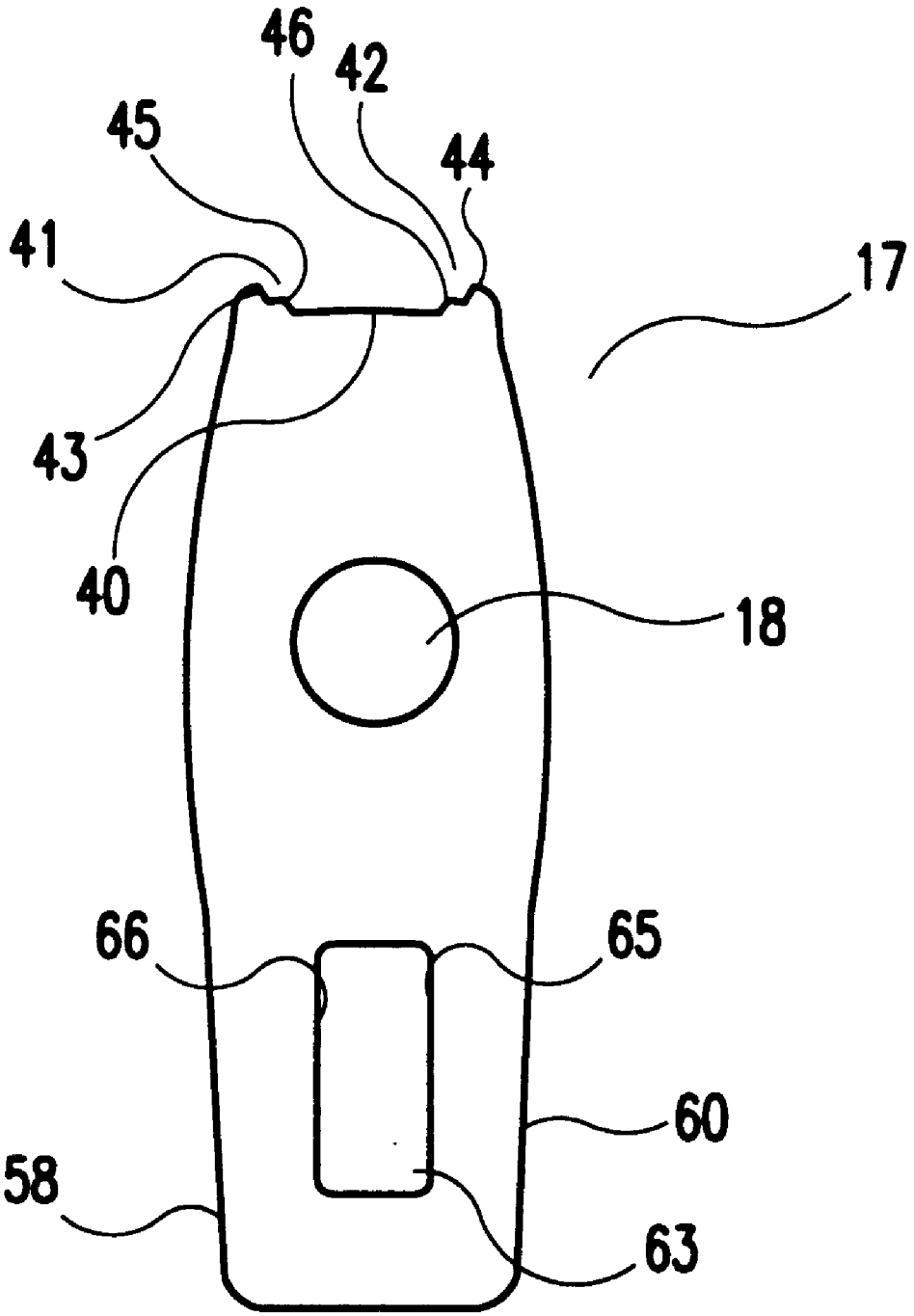
FIG. 12 is an elevation view of an alternative pawl for use in connection with the ratchet wrench of the present invention.
Figure 13:
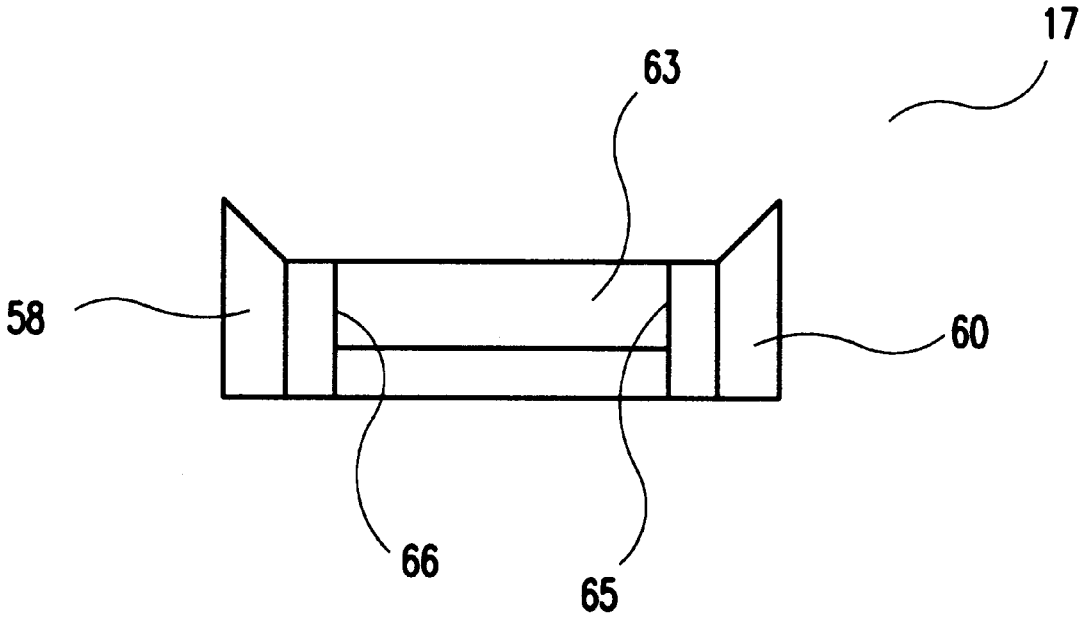
FIG. 13 is an end view of the pawl of the ratchet wrench of the present invention taken along line a—a of FIG. 4.

Pawl 17 is releasably retained in a desired orientation with respect to ratchet gear 26 by a cam 70, positional post 72, capscrew 19 and lips 61 and 62. Movement of pawl 17 along the longitudinal axis of wrench 10 is prevented by capscrew 19 and shoulder 53. Movement of pawl 17 in a direction perpendicular to wrench 10 is prevented by lips 61, 62. Cam 70 consists of two substantially rectangular halves connected by a stabilizing bar 78 inserted through the midsection of each rectangular half (see FIG. 4). The distal end of cam 70 has two cylindrical rods 79 protruding therefrom for receiving springs 74. The cam assembly 70 is inserted into pawl 17 via channel 63. Channel 63 extends from an opening 64 at the proximal end of pawl 17 to just below aperture 18, and extends approximately three-quarters of the way through pawl 17 (See FIG. 13). In another embodiment, channel 63 does not extend all the way to the proximal end of pawl 17 (See FIG. 12). The proximal end of the two halves of cam 70 have interior edges slightly higher than the exterior edges. The interior edges are adjacent to one another and form a detent 75 in which positional post 72 rests to secure pawl 17 in the neutral position. Positional post 72 also rests in detents formed by walls 65, 66 of channel 63 and the outer edges 76, 77 of cam 70. As will be explained below, the retaining system defines three orientations of pawl 17 that respectively bias the pawl in a first, second and third position as illustrated, respectively, in FIGS. 9, 10 and 11.

When pawl 17 is in the neutral position, positional post 72 maintains pawl 17 in that position by resting in detent 75 of cam 70. In the neutral position, the ratchet wrench 10 can be placed on a fastener which is loosely fitted on a threaded device, and the ratchet wrench 10 can then be rotated in either the clockwise or counterclockwise direction without rotating the fastener. When force is applied to tab 60, pawl 17 pivots in a clockwise direction, causing positional post 72 to rest in a detent formed by outer edge 77 and channel wall 65, and further causing steps 41 to engage ratchet gear 26. When force is applied to tab 58, pawl 17 pivots in a counterclockwise direction, causing positional post 72 to rest in a detent formed by outer edge 76 and channel wall 66, and further causing steps 42 to engage ratchet gear 26.

The various elements of the invention cooperate to allow the precise and efficient turning of a fastener in a clockwise or counterclockwise direction. When pawl 17 is moved into the position as illustrated in FIG. 1, it drives ratchet gear 26 and an engaged fastener only when handle 12 is moved counterclockwise about the axis of rotation of the ratchet gear 26. When pawl 17 is moved into the position illustrated in FIG. 10, it drives ratchet gear 26 and an engaged fastener only when handle 12 is moved clockwise about the axis of rotation of the ratchet gear 26. The direction in which the fastener is driven is reversed by changing the position of pawl 17 by a slight movement of the fingers of one hand, the hand holding the wrench, without disengaging the wrench from the fastener.

When driving a fastener by rotating the wrench 10 in either a clockwise or counterclockwise direction, the force created by the rotation, and which the wrench 10 must bear, is distributed by the wrench in one of two ways. In the preferred embodiment, wherein aperture 18 and capscrew 19 are round in shape, the teeth 28 of the ratchet gear 26 transfer the force to the steps 41 or 42 of pawl 17, and that force is then transferred through the pawl 17 to the capscrew 19. The force is borne by the wrench 10 in a slightly different manner in the embodiment wherein the aperture 18 is slightly oval, and the end of pawl 17 and shoulder 53 are convex and concave respectively. In that embodiment, the force borne by the wrench 10 is transferred from the gear 26 to the pawl 17 as just described in connection with the preferred embodiment, however, instead of transferring the force to capscrew 19, the pawl 17 transfers the force to the concave shoulder 53 via the convex end of pawl 17.

It will be appreciated by those skilled in the art and it is contemplated that variations to the embodiments illustrated and described herein may be made without departing from the spirit and scope of the present invention. Accordingly, it is intended that the foregoing description is illustrative only, and that the true spirit and scope of the invention will be determined by the appended claims.

Having thus described my invention, what I claim as new and desire to secure by Letters Patent is as follows:

1. A ratchet wrench comprising:

a handle;

a housing attached to one end of said handle;

a ratchet gear mounted for rotation in said housing, said ratchet gear having an axis of rotation extending through said housing;

means connected to said ratchet gear for turning a threaded fastener;

a pawl mounted on said handle about a pivot axis that extends through said handle, said pawl pivoting among a first position in which said pawl permits unrestricted rotation of said ratchet gear, a second position in which said pawl engages said ratchet gear to prevent rotation of said ratchet gear in one direction but allows rotation of said ratchet gear in an opposite direction, and a third position in which said pawl engages said ratchet gear to prevent rotation of said ratchet gear in said opposite direction but allows rotation of said ratchet gear in said one direction; and a shoulder on said handle, wherein said pawl does not extend beyond said shoulder, thereby preventing unintended changes in the position of said pawl, and wherein said pawl is exposed and is engageable by a finger of a user.

2. The ratchet wrench of claim 1, wherein said pawl is displaced to said second position by applying a clockwise force to said pawl, below said pivot axis of said pawl, thereby causing said pawl to engage said ratchet gear preventing said ratchet gear from rotating in said one direction.

3. The ratchet wrench of claim 1, wherein said pawl is displaced to said third position by applying a counterclockwise force to said pawl, below said pivot axis of said pawl, thereby causing said pawl to engage said ratchet gear preventing said ratchet gear from rotating in said opposite direction.

4. The ratchet wrench of claim 1, wherein said pawl contains steps, said steps for engaging said gear and preventing the rotation of said gear in said one direction or said opposite direction.

5. The ratchet wrench of claim 1, wherein said pawl has a top surface orthogonal to said pivot axis, said top surface being exposed and engageable by a finger of a user.

6. A ratchet wrench comprising:

a handle;

a housing attached to one end of said handle;

a ratchet gear mounted for rotation in said housing, said ratchet gear having an axis of rotation extending through said housing;

means connected to said ratchet gear for turning a threaded fastener;

a pawl mounted on said handle about a pivot axis that extends through said handle, said pawl pivoting among a first position in which said pawl permits unrestricted rotation of said ratchet gear, a second position in which said pawl engages said ratchet gear to prevent rotation of said ratchet gear in one direction but allows rotation of said ratchet gear in an opposite direction, and a third position in which said pawl engages said ratchet gear to prevent rotation of said ratchet gear in said opposite direction but allows rotation of said ratchet gear in said one direction; and a cam in communication with said pawl, said cam comprising at least one spring on one end of said cam, said spring biasing said cam away from said pivot axis of said pawl.

7. The ratchet wrench of claims 6, wherein said cam is comprised of two longitudinal halves, said halves forming a detent at a point of junction of said halves, said point of junction at an end opposite said end of cam with said spring, said detent securing a neutral position of said pawl.

8. The ratchet wrench of claim 7, wherein said cam further forms two detents for securing said second position and said third position of said pawl, said second position and said third position causing said pawl to engage said ratchet gear.

9. The ratchet wrench of claim 8, wherein said two longitudinal halves are affixed to each other by a stabilizing bar inserted through said halves.

10. The ratchet wrench of claim 6, wherein said cam and said spring are carried by said pawl.

* * * * *